US007210887B2

(12) United States Patent
Engert et al.

(10) Patent No.: US 7,210,887 B2
(45) Date of Patent: May 1, 2007

(54) BOOKBINDING MACHINE

(75) Inventors: Holger Engert, Rahden (DE); Jürgen Garlichs, Rahden (DE)

(73) Assignee: Kolbus GmbH & Co. KG, Rahden (DE)

( * ) Notice: Subject to any disclaimer, the term of this patent is extended or adjusted under 35 U.S.C. 154(b) by 415 days.

(21) Appl. No.: 10/437,847

(22) Filed: May 14, 2003

(65) Prior Publication Data

US 2003/0215309 A1 Nov. 20, 2003

(30) Foreign Application Priority Data

May 15, 2002 (DE) ..... 102 21 542

(51) Int. Cl.
*B42B 5/00* (2006.01)

(52) U.S. Cl. ..... 412/33; 412/6; 412/8; 412/14; 412/20; 270/52.18

(58) Field of Classification Search ..... 412/1, 412/6, 8–9, 14, 20, 33; 270/52.18, 58.07
See application file for complete search history.

(56) References Cited

U.S. PATENT DOCUMENTS

| | | | | |
|---|---|---|---|---|
| 1,791,081 | A * | 2/1931 | Seiter | 227/29 |
| 4,556,353 | A * | 12/1985 | Ehlermann | 412/5 |
| 4,653,972 | A * | 3/1987 | Lewis | 412/19 |
| 5,011,123 | A * | 4/1991 | Vigano' | 270/52.04 |
| 5,054,984 | A * | 10/1991 | Chan et al. | 412/1 |
| 5,489,969 | A * | 2/1996 | Soler et al. | 399/18 |
| 5,874,812 | A * | 2/1999 | Chang | 318/35 |
| 6,193,458 | B1 * | 2/2001 | Marsh | 412/1 |
| 6,250,868 | B1 * | 6/2001 | Schmucker | 412/25 |
| 6,257,567 | B1 * | 7/2001 | Hansmann et al. | 270/58.07 |
| 6,352,252 | B1 * | 3/2002 | Schmucker et al. | 270/58.07 |

(Continued)

FOREIGN PATENT DOCUMENTS

DE 24 58 543 C2 6/1976

(Continued)

OTHER PUBLICATIONS

German Search Report, Apr. 2003 (entire document).

*Primary Examiner*—Monica Carter
*Assistant Examiner*—Eric A. Gates
(74) *Attorney, Agent, or Firm*—Alix, Yale & Ristas, LLP

(57) ABSTRACT

A bookbinding machine for processing inner books includes a transport system with a multiplicity of inner-book clamps continually movable in a closed continuous track. Each of the inner book clamps is articulated to a circulating roller chain and has a rear-edge stop for aligning the inner books. The bookbinding machine includes workstations that perform positionally accurate operations on the inner books including the application of glue, the application of reinforcement or gauze sections, the application of jackets, binding with wire stitches, the introduction of utilisation features (e.g. punched holes, tear-off perforations, etc.) and the like. The transport system of the inner-book clamps and at least one workstation are driven independently of one another. A measuring system for positional detection of the inner-book clamps or of the inner books is provided in proximity to the independently driven workstation. The measuring system provides inner book or clamp position data used to control the workstation performing positionally accurate operation on the relevant inner book.

23 Claims, 2 Drawing Sheets

U.S. PATENT DOCUMENTS 6,619,900 B2 * 9/2003 Cobene et al. ..... 412/1
6,764,069 B2 * 7/2004 Reist ..... 270/52.29

FOREIGN PATENT DOCUMENTS

DE 31 39 656 C2 4/1983
DE 198 46 525 A1 4/2000
DE 198 59 333 A1 7/2000
WO WO 02/36474 * 5/2002

* cited by examiner

BOOKBINDING MACHINE

This application claims the benefit of German Patent Application No. DE 102 21 542.1, filed May 15, 2002.

BACKGROUND OF THE INVENTION

1. Field of the Invention

The present invention relates generally to a bookbinding machine and more specifically to a bookbinding machine in which the drives of workstations for performing positionally accurate operations on inner books are not mechanically coupled to the main drive for the book binding machine.

2. Description of the Related Art

A bookbinding machine to which the invention relates is described, for example, in DE 198 46 525 A1 and is also referred to as an adhesive binder having a clamp system. One inner book in each case is clamped by an inner-book clamp while standing on its spine and in this position is transported past various stations. In addition to stations for processing the inner-book spine, such as cutting-off, notching, roughing and brushing, stations are provided for applying adhesive to the spine and/or to the lateral faces close to the spine, for applying reinforcement or gauze sections and for applying jackets. In addition, there are stations for drying and contact pressing and stations for moving the products in and out. The equipment of an adhesive binder having the various stations depends on the products to be manufactured. It is, of course, limited by the available space, which is determined by the number of inner-book clamps.

The transport system with the inner-book clamps consists of a multiplicity of inner-book clamps that are movable via horizontal and vertical rollers in upper and lower guide rails forming a closed, continuous track in a frame. The inner-book clamps are articulated at equal mutual pitch distances from one another to a continuous roller chain driven in known fashion via a chainwheel. The chainwheel is in turn driven via a drive system consisting of a motor, transmission and angular gears and further drive shafts connecting the different components. As an example, a transport system with inner-book clamps is described in DE 24 58 543 C2. When being transferred to the inner-book clamp, the inner book to be clamped is aligned to a rear-edge stop of the inner-book clamp.

To carry out accurately-timed processing the stations designated for this purpose are connected by direct mechanical coupling via a main shaft to the drive system of the transport system of the inner-book clamps. The respective drive connections are adjusted in relation to the rear-edge stop of the inner-book clamps. In addition, functions are performed in adhesive binders which are driven pneumatically or electromechanically. Their actuation is controlled using the signals from a shaft encoder measurement system which is arranged in the drivetrain on the main shaft of the adhesive binder to capture the absolute rotary motion of said shaft. A theoretical position on the inner-book clamp is associated with the particular angular position of this shaft.

The exact positions of the individual inner-book clamps at a particular time are not, however, determined by this indirect measuring system. Oscillations of the drive system superimposed on the chain movement, unequally-stretched sections of the roller chain and play in the drive links are not allowed for in determining the position of the inner-book clamp. The processing functions dependent thereon are performed in a correspondingly inaccurate manner. Moreover, the case is similar with the mechanically coupled stations, since chain stretching or the actual distances in the chain pitches can only be accounted for in terms of all the inner-book clamps as mediated through the adjustment of the drive coupling; furthermore, in the case of spatially extensive drive connections synchronising inaccuracies as a result of play and oscillations are increased. In particular when applying jackets, however, exact coordination of the feed of a jacket with the transporting of the inner book allocated thereto is required. Known from DE 31 39 656 C2 is a jacket application station in which circulating alignment elements for the jackets move between two inner-book clamps and are resiliently braked and aligned by abutting against the rear edges of the inner-book clamps or of the inner books.

SUMMARY OF THE INVENTION

It is an object of the present invention to create a bookbinding machine of the above-mentioned type which makes possible the performance of precise positioning operations in workstations while being of simple construction.

This object is achieved according to aspects of the present invention by abolishing the mechanical coupling of the drives of the workstations to the drive of the transport system of the inner-book clamps, and in driving the former and latter elements independently of one another. Another aspect of the invention relates to a measuring system being provided for detecting the position of the inner-book clamps or the inner books in the vicinity of a workstation for controlling the timing of workstation operations on the inner books. Adjacent workstations may be controlled as a function of the position detected from a single sensor.

The mechanically uncoupled workstations are driven by motors, or are driven hydraulically, pneumatically or electromechanically. The drive system is broken up into small partial systems less subject to oscillations. Operations performed by the workstations are carried out markedly more accurately because the position sensing is carried out locally. Electronic controls make adjustment of the machine simpler and more precise. Further, a bookbinding machine according to the invention simplifies the replacement or addition of workstations because the adjustment of the drive connections in relation to the rear edge of the transported inner books is dispensed with. An advantage of the bookbinding machine according to the invention is that work processes dependent on inner-book position, such as side-stitching, punching, gluing, reinforcing, jacket application, etc., take a substantially simpler form. This advantage is characterised, among other benefits, by a smaller installation space requirement.

A preferred embodiment of the inventive bookbinding machine is provided when all workstations, previously coupled mechanically, are driven independently of the drive of the transport system of the inner-book clamps. The main shaft can thereby be dispensed with. But even partial mechanical uncoupling offers advantages if, for example, workstations are to be used in bookbinding machines which are differently configured with respect to the central drive system.

The bookbinding machine may be provided with a monitoring station for carrying out optical quality control procedures with respect to the operations performed, this monitoring station being controlled as a function of the detected exact position of the inner-book clamps or of the inner books.

A position control system which coordinates the independent drives with one another during operation and/or after interruptions of operation is expediently associated with the individual drives. Different control systems can be used. The workstations arranged in the vicinity of the deflector wheel of the traction means of the transport system are advantageously controlled by the position signals of a shaft encoder measurement system fitted to this wheel. Very precise detection of the position of the inner-book clamps in this area is thereby provided. The position detection is preferably effected by means of a linear distance measuring system. The use of a plurality of sensing heads located in the area of a workstation is expedient here. The different operations are thereby carried out substantially more accurately. An aspect of the invention relates to a bookbinding machine that automatically adapts itself to changing conditions in the transport system of the inner-book clamps.

The mechanically uncoupled workstations are advantageously designed to be compatible with the timing distances in different bookbinding machines (also referred to as adhesive binders). When used in a bookbinding machine having a given timing (pitch) distance (T) between the inner-book clamps, the workstations are adjustable to this timing distance. The construction of variants with respect to timing distances is rendered superfluous. In addition, the production, storage and preparation for service of these workstations are greatly simplified. It is also advantageous that the workstations are electronically adjustable with respect to the positions or format height of the inner books.

BRIEF DESCRIPTION OF THE DRAWINGS

The invention will now be elucidated in more detail with reference to an embodiment illustrated in the drawings, in which.

DETAILED DESCRIPTION OF AN EXEMPLARY EMBODIMENT

Figure 1:
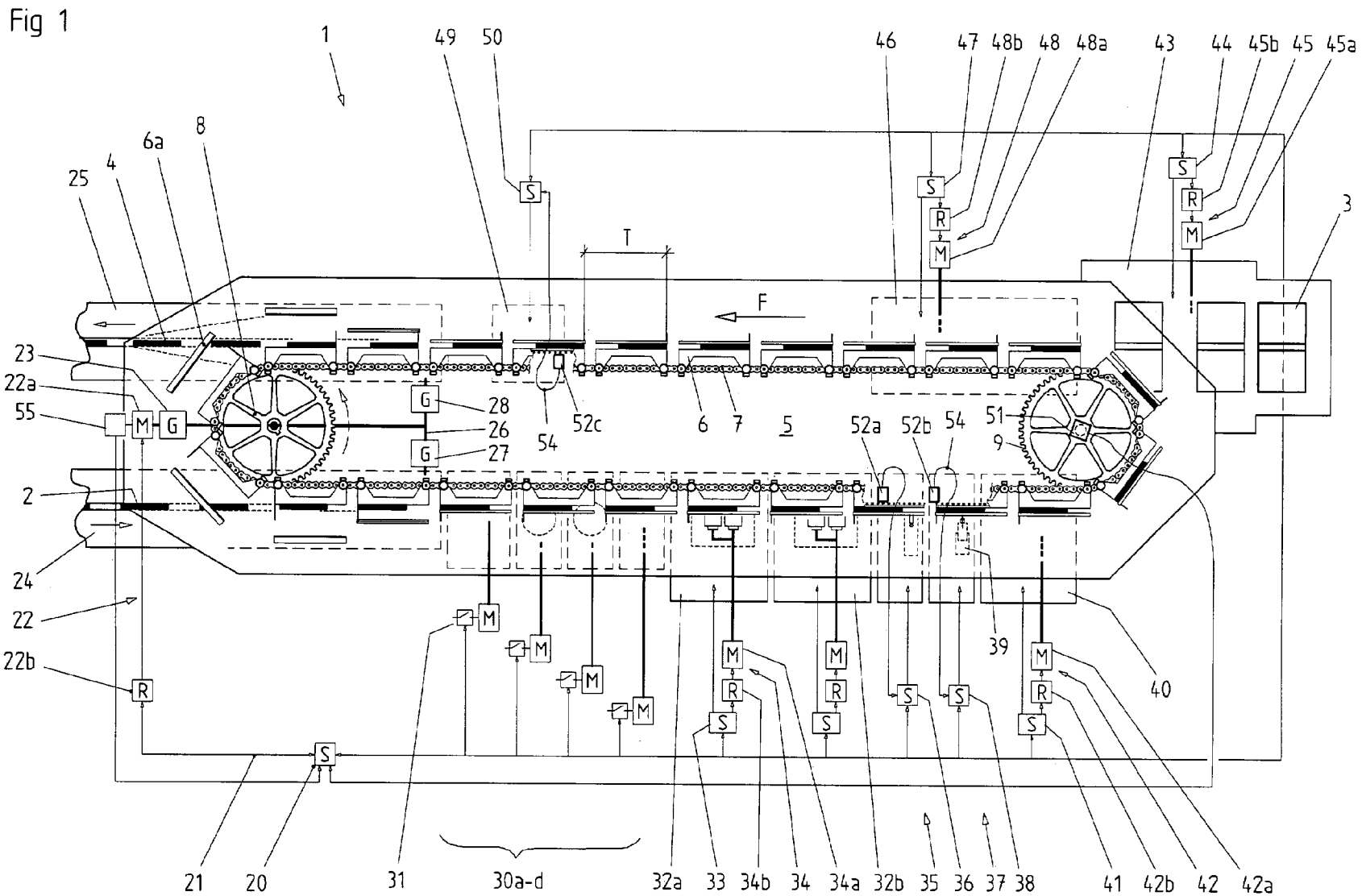
FIG. 1 is a simplified top view of a bookbinding machine including schematic representations of drive and control components and interconnections.
Figure 2:
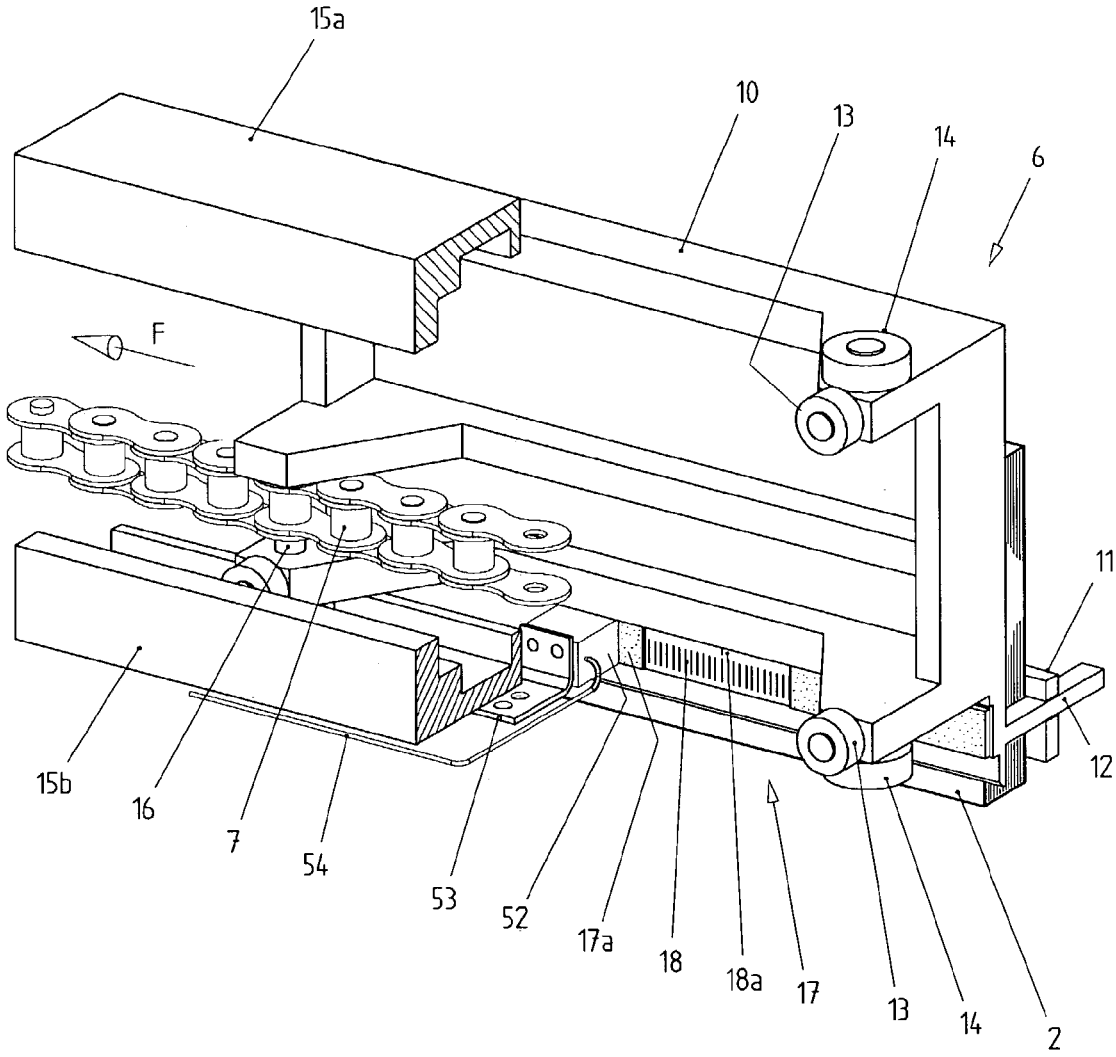
FIG. 2 is an enlarged reverse perspective view of an inner-book clamp appropriate for use in conjunction with the bookbinding machine of FIG. 1, the inner book clamp is shown in functional conjunction with an upper and lower guide rail and roller chain (both broken away), a sensor and bracket are also shown.

An exemplary embodiment of a bookbinding machine 1 consists of a transport system 5 having a multiplicity of continuously movable inner-book clamps 6 articulated to a continuous roller chain 7 circulating in a closed track, spine-processing stations 30*a–d* and workstations 32, 35, 37, 40, 43 and 46 for carrying out positionally precise processing operations. Inner books 2 collated as loose sheets are bound in the bookbinding machine 1 and, in a processing variant, are finished as brochures 4 by the application of a jacket 3. The inner books 2 enter the bookbinding machine 1 while standing on their spines via an intake 24. They are transferred, while being aligned to a rear-edge stop 12, to the inner-book clamps 6 which, starting from an open position 6*a*, clamp the particular inner book 2 by its lateral faces with an inner jaw 10 and an outer jaw 11 closing relatively thereto. A given portion of the inner book projects downwardly from the inner-book clamp 6 for processing.

The inner-book clamps 6 are supported during movement in the transport direction F by means of horizontal and vertical rollers 13 and 14 in upper and lower guide rails 15*a*, 15*b*. The upper and lower guide rails 15*a*, 15*b* form a closed continuous track. The inner-book clamps 6 are articulated at equal mutual pitch distances T to the roller chain 7 by means of axle pins 16. The roller chain 7 is driven via a drive chainwheel 8 and a deflector chainwheel 9 to form an oval continuous track. The drive chainwheel 8 is connected in turn via a transmission 23 to a drive 22 formed by a motor 22*a* and a control unit 22*b*. The drive 22 is monitored and controlled by a central position control unit 20 communicating with local control units via signal lines 21. The exact position of said drive 22 is transmitted to the position control unit 20 via a resolver feedback 55. The intake mechanism 24 and an output mechanism 25 which removes the brochure 4 from the opening inner-book clamp 6,6*a*, are driven with direct mechanical coupling 26 by the drive 22, the drive connection 26 including transmissions 27, 28. In the embodiment described here the coupling of further stations to the drive 22 is not provided. The drive system thereby has a compact and mechanically simple configuration.

The different stations are arranged along rectilinear sections of the transport system 5, the spine processing stations 30*a–d* first processing the spine of the inner book in the sequence: cutting-off, notching, roughing and brushing. The stations 30*a–d* are driven by drives 31 in each case. Processing is not effected in relation to timing or position. The drives 31 are therefore merely switched on and off by the central control unit 20.

The processing of the spine is followed by gluing of the spine and the adjacent lateral areas. In the present embodiment two spine gluing stations 32*a*, 32*b* are provided which remove the glue from a glue store with rotationally-driven gluing rollers and transfer it to the spine, the application thickness being adjustable by a scraper plate, which may also be referred to as a "doctor blade". The position of the scraper is controllable between a zero position and a glue position. In the zero position the scraper reduces the height of glue on the roller to zero by scraping the glue off the roller. In the glue position, the scraper is spaced from the roller such that glue remains on the roller to be applied to the inner book. The scrapers are pneumatically or electromechanically controllable so that the glue is applied with positional accuracy to the inner book. The gluing rollers are connected to a drive 34 which is composed of a frequency-controlled (servo) motor 34*a* and a control unit 34*b* and is controlled by an overriding control unit 33. The control unit 33 also controls the pneumatically or electromechanically driven scrapers, the resolver feedback 55 being taken into account via the position control unit 20. A side-gluing station 37 which applies the glue with application heads 39 and associated nozzles is provided for gluing the lateral areas close to the spine. A control unit 38 activates the associated valves of the application heads 39, the signals of a position detection arrangement located directly ahead of the application heads being taken into account.

The position detection arrangement is a linear distance measuring system having material measures 17 attached to the inner-book clamps 6, with a measuring strip 18 protected by a covering strip 17*a* and having a periodic measuring position and with fixed sensing heads 52, 52*a–c* on holders 53. As the inner-book clamps 6 are moved the sensing heads 52 supply with the signal line 54 incremental signals together with a distance-coded reference signal which is tapped by a reference track 18*a* located parallel to the measuring position and determines the absolute position of the inner-book clamp 6 concerned. For the side-gluing station 37 the exact position of the inner-book clamp is detected with the sensing head 52*b*. From this position the control unit 38 determines the times for triggering and ending the application process according to the predefined position while taking account of the actual running speed of the bookbinding machine 1, the delay times of the different actuators and further influence values.

A side-stitching station 35 which drives wire stitches through or into the inner books 2 from the side in the area adjacent to the spine with pneumatically driven stitching heads is arranged ahead of the side-gluing operation. Its operation is comparable to that of the side-gluing station 37. For this operation the associated control unit 36 receives position signals from the sensing head 52*a*. By means of optional monitoring of the glue applications and/or the stitching by a monitoring station of the same kind as the monitoring station 49 described below, positions are checked and deviations from the reference positions are detected, among other checks. The fundamental delay times of the different stations 32*a*, 32*b*, 35 and 37 due to their actuators are correspondingly changed in the associated control units 33, 36 and 38. An adaptive adjustment to changing conditions takes place.

The stations 40, 43 and 46 which now follow are arranged in the area of the deflector chainwheel 9. The positions of the inner-book clamps 6 in this area can be determined with considerable accuracy from the absolute angular position of this wheel, for which reason a measuring system with a shaft encoder 51 is provided in that location. The position control unit 20 has access to the position signals generated at this location and sends control signals relating thereto to the stations arranged in that area. These are, specifically, the reinforcement station 40, the jacket application station 43 and the contact pressing station 46. Associated with each of these stations is a respective drive 42, 45 and 48 composed of a respective servo motor 42*a*, 45*a* and 48*a* and a respective servo control unit 42*b*, 45*b* and 48*b*. Overriding each of these drives are further respective control units 41, 44 and 47 which communicate with the position control unit 20 and control functions in the stations 40, 43 and 46 which are not dependent on the drives of these stations or controlled thereby. Through the position detection effected close to the stations positioning operations to be carried out in the stations, i.e. the application of the reinforcing strip, the application of the jacket and pressing of the jacket against the spine are carried out considerably more accurately than if position detection were taken account of by the resolver feedback 55.

A monitoring station 49 for performing optical quality control procedures is provided after the contact pressing station 46. For example, the position of the jacket 3 on the inner book 2 is checked. For this purpose it is important to coordinate the corresponding signal of a light barrier with a very specific position of the inner-book clamp 6. The exact position of the inner-book clamp 6 is determined using the linear distance measuring system and specifically by the sensing head 52*c* arranged in the monitoring station. As described above, a monitoring station which carries out a quality control operation by image processing is optionally provided after the gluing operation. The image of the glued spine of the inner book to be assessed by the quality control system must be acquired at a specific position of the inner-book clamp 6 which is determined using the linear distance measuring system.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A bookbinding machine for processing inner books comprising:

a transport system having a multiplicity of inner-book clamps for holding a respective multiplicity of inner books, said clamps continuously movable in a closed continuous track including rectilinear sections and articulated to a circulating conveyor driven by a first drive, which inner-book clamps have a rear-edge stop for aligning the inner books;

a plurality of workstations driven by at least one second drive for performing a respective plurality of diverse, positionally accurate operations on said inner books; and a measuring system independent of said first drive, that detects a position of a clamped inner book or the inner book clamp, while said book or clamp is moving toward each of said workstations;

wherein said first and second drives operate independently of one another and said positions are detected in proximity to said workstations and used to control said diverse, positionally accurate operations.

2. The bookbinding machine of claim 1, wherein said plurality of workstations comprises a jacket application station for the positionally accurate application of jackets to said inner books.

3. The bookbinding machine of claim 2, wherein said plurality of workstations comprises at least one contact pressing station located after the jacket application station, said contact pressing station being driven independently of the transport system.

4. The bookbinding machine of claim 1, wherein said inner books have a spine and lateral faces close to the spine, said plurality of workstations comprising gluing stations having rotationally driven glue application rollers and controlled scrapers for the positionally accurate application of glue to the inner book at locations selected from the spine of the inner book and the lateral faces close to the spine, said glue application rollers being driven independently of said transport system and said scrapers being controlled independently of said transport system.

5. The bookbinding machine of claim 1, wherein said inner books have spines and lateral faces close to the spine, said plurality of workstations comprising gluing stations having application heads for the positionally accurate application of glue by means of nozzles to the inner book at a location selected from the spine and the lateral faces of the inner books close to the spine, which in each case are controllable independently of said transport system.

6. The bookbinding machine of claim 1, wherein said plurality of workstations comprises a reinforcing station for the positionally accurate application of a reinforcement or a gauze section to said inner books, said reinforcing station being driven independently of the transport system.

7. The bookbinding machine of claim 1, wherein said plurality of workstations comprises at least one side-stitching station for the positionally accurate binding of the inner books with laterally inserted wire stitches, said at least one side-stitching station being driveable independently of the transport system.

8. The bookbinding machine of claim 1, wherein said plurality of workstations comprises a monitoring station for performing optical quality control procedures on said inner books following said positionally accurate operations.

9. The bookbinding machine of claim 8, wherein said optical quality control procedures comprise an image-processing quality control procedure.

10. The bookbinding machine of claim 1, wherein each of said plurality of workstations being driven independently of said other workstations and some of said workstations including electronically controlled components for performing operations on said inner books, said bookbinding machine comprising:

a control unit operatively connected to coordinate the independently driven workstations and the operations performed by said electronically controlled components.

11. The bookbinding machine of claim 1, wherein said first and second drives are servo drives.

12. The bookbinding machine of claim 1, wherein said first and second drives are servo drives and said first drive is configured as the master drive and the second drive is configured as a slave drive.

13. The bookbinding machine of claim 1, wherein said first drive is a servo drive that is monitored and controlled by a central position control unit and said second drive is a servo drive controlled by a local controller, said central position control unit configured as a virtual master and the second drive configured as a slave drive.

14. The bookbinding machine of claim 1, wherein said circulating conveyor is a roller chain secured around a drive chainwheel and a deflector chainwheel and one of said plurality of workstations is located adjacent said deflector chainwheel, said bookbinding machine comprising:

a shaft encoder measurement system arranged on the deflector wheel to provide deflector wheel position data to a master position control unit, wherein said deflector wheel position data is used by said master position control unit to control said positionally accurate operations.

15. The bookbinding machine of claim 1, wherein said measuring system comprises a linear distance measuring system including at least one sensing head fixed in the area of a workstation for exact positional detection of the inner-book clamps, wherein the workstations in proximity to the sensing head are controlled as a function of said positional detection.

16. The bookbinding machine of claim 15, wherein said at least one sensing head comprises a plurality of sensing heads.

17. The bookbinding machine of claim 15, wherein said sensing head captures a reference, said bookbinding machine using said reference to determine an absolute position of the inner-book clamp, the reference selected from an edge of the inner-book clamp or of the inner book which is detectable by a light barrier, or a reference track fixed to the inner book clamp.

18. The bookbinding machine of claim 1, wherein said inner book clamps are articulated to said conveyor at a pitch distance (T) from adjacent inner book clamps and said at least one workstation is adjustable for different pitch distances (T).

19. The bookbinding machine of claim 1, wherein the transport system and the plurality of workstations are driven by separate servo drives and the position of the positionally accurate operations carried out on the inner book in said workstations are electronically adjustable by means of the servo drives.

20. The bookbinding machine of claim 1, wherein said measuring system comprises at least one sensing head located in proximity to each of said workstations.

21. The bookbinding machine of claim 1, wherein the measuring system generates incremental signals together with a distance coded reference signal to determine the absolute position of said moving book or clamp before the book or clamp arrives at the location where the positionally accurate operations are to be performed at said workstations.

22. A bookbinding machine for processing inner books comprising:

a transport system having a multiplicity of inner-book clamps for holding a respective multiplicity of inner books, said clamps continuously movable in a closed continuous track including rectilinear sections and articulated to a circulating conveyor driven by a first drive, which inner-book clamps have a rear-edge stop for aligning the inner books;

at least one workstation driven by a second drive for performing positionally accurate operations on said inner books;

a measuring system that detects a position of a clamped inner book or the inner book clamp, while said book or clamp is moving toward said workstation;

wherein said first and second drives operate independently of one another and said position is detected in proximity to said workstation and used to control said positionally accurate operations;

wherein said transport conveyor is a roller chain secured around a drive chainwheel and a deflector chainwheel and said at least one workstation is located adjacent said deflector chainwheel;

a shaft encoder measurement system is arranged on the deflector wheel to provide deflector wheel position data to a master position control unit; and wherein said deflector wheel position data is used by said master position control unit to control said positionally accurate operations.

23. A bookbinding machine for processing inner books comprising:

a transport system having a multiplicity of inner-book clamps for holding a respective multiplicity of inner books, said clamps continuously movable in a closed continuous track including rectilinear sections and articulated to a circulating conveyor driven by a first drive, which inner-book clamps have a rear-edge stop for aligning the inner books;

at least one workstation driven by a second drive for performing positionally accurate operations on said inner books;

a measuring system that detects a position of a clamped inner book or the inner book clamp, while said book or clamp is moving toward said workstation;

wherein said first and second drives operate independently of one another and said position is detected in proximity to said workstation and used to control said positionally accurate operations; and wherein said inner book clamps are articulated to said conveyor at a pitch distance (T) from adjacent inner book clamps and said at least one workstation is adjustable for different pitch distances (T).

* * * * *